US005505523A

United States Patent [19]

Wang

[11] Patent Number: 5,505,523

[45] Date of Patent: Apr. 9, 1996

[54] SAFETY NAP CUSHION FOR USE WITH A CHAIR BACK

[76] Inventor: Ful-Lang Wang, 4F., No. 1, Alley 19, Lane 113, Sec. 3, Chienkwo N. Rd., Taipei, Taiwan

[21] Appl. No.: 388,313

[22] Filed: Feb. 14, 1995

[51] Int. Cl.[6] ..... A47C 7/36

[52] U.S. Cl. ..... 297/393; 297/397; 5/637; 5/640; 5/644; 128/870

[58] Field of Search ..... 297/393, 397; 5/637, 633, 640, 644; 128/869, 870, DIG. 20, 876

[56] References Cited

U.S. PATENT DOCUMENTS

| | | | |
|---|---|---|---|
| 2,589,155 | 3/1952 | Smith | 5/637 |
| 3,296,634 | 1/1967 | Rusnak | 297/393 |
| 3,897,777 | 8/1975 | Morrison | 5/637 |
| 4,182,322 | 1/1980 | Miller | 5/637 |
| 4,550,458 | 11/1985 | Fiore | 5/637 |
| 4,679,263 | 7/1987 | Honer | 5/640 |
| 5,311,882 | 5/1994 | Gagne | 5/637 |
| 5,441,479 | 8/1995 | Chitwood | 128/870 |

*Primary Examiner*—Peter R. Crown
*Assistant Examiner*—Anthony D. Barfield

[57] ABSTRACT

A safety nap cushion for use with a chair back mainly consisting of a reverse U-shaped inflatable back cushion having a central opening, two properly curved inflatable side cushions thermally-sealed to two front sides of the back cushion to softly and fitly confine a user's head therebetween, and a length-adjustable retaining strap detachably attached to the back cushion and suitable for being pivotally turned to a position in front of the side cushions to fitly confine the latter and prevent the latter from swaying laterally under pressure. The back cushion is fixly attached to a chair back by engaging hook members with retaining rings provided at its two sides. The side cushions each has a properly curved inner side surface and are so designed that a smooth curve is formed at a lower joint between thed back cushion and the two side cushions to comfortably support the user's head.

1 Claim, 3 Drawing Sheets

SAFETY NAP CUSHION FOR USE WITH A CHAIR BACK

BACKGROUND OF THE INVENTION

The present invention relates to a safety nap cushion for use with a chair back, and more particularly to a safety nap cushion which softly contacts with the user's two cheeks.

In an airplane, the cabins are generally divided into the economy class and the first class. The difference between these two classes is mainly in the comfort of the seats. The seats in the economy class cabin are simple and narrower in design and do not give the passengers much room to move or stretch the body. The seats in the first class cabin are designed to provide higher comfort and are therefore wider and meet the principle of ergonomics. However, neither the economy nor the first class seats can allow the users to nap comfortably when they travel on the plane for a long time. Although the seats in the first class cabin are wider than the seats in the economy class cabin, a napped or asleep passenger in the seat may still fall aslant to one side and unawares disturbs the neighbor passenger, not to mention when sitting in a narrower economy class seat. Moreover, napping or sleeping with the neck falling aslant to one side tends to easily cause a sore and stiff neck. Therefore, it is desirable to develop and provide a means on which a passenger travelling on a plane or a long distance bus may rest his or her head for a nice sleep or nap.

SUMMARY OF THE INVENTION

It is a primary object of the present invention to provide a safety nap cushion for use with a chair back which may softly contact the user's two cheeks and thereby allows the user to nap or sleep in the seat in a carefree, stable, and completely relaxed position.

DETAILED DESCRIPTION OF THE PREFERRED EMBODIMENTS

Figure 1:
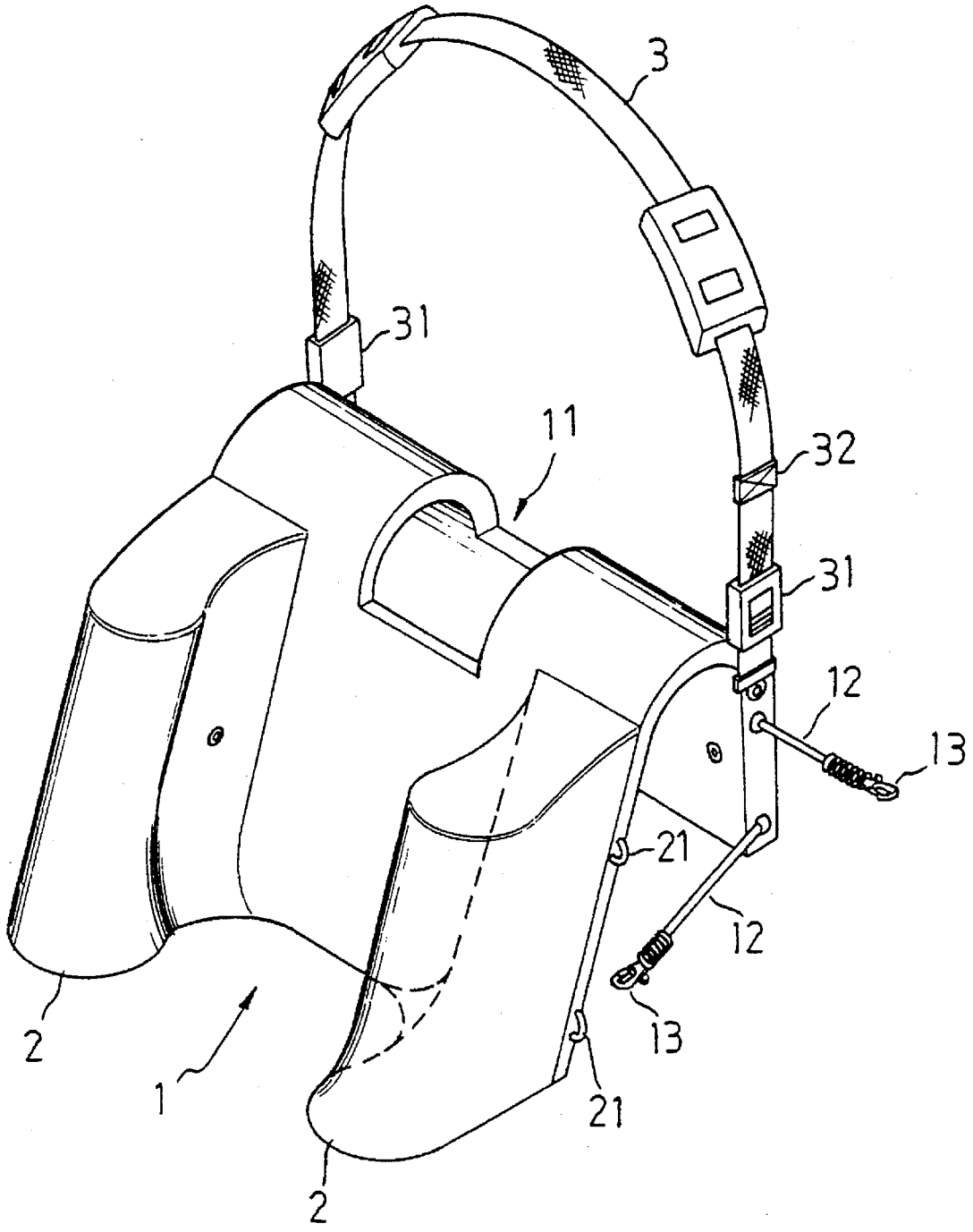
FIG. 1 is a perspective view showing the safety nap cushion for use with a chair back according to the present invention.

Please refer to FIG. 1. The safety nap cushion for use with a chair back according to the present invention mainly consists of a reverse U-shaped inflatable back cushion 1 including a front portion and a rear portion and having a through opening 11 formed at a predetermined position between the front and the rear portions thereof, two properly curved inflatable side cushions 2 being thermally sealed to a top surface of the front portion of the back cushion 1 at each side thereof, and a pivotally movable retaining strap 3 connected at two lower ends to two outer side surfaces of the rear portion of the back cushion 1 by means of safety buckles 31.

The back cushion 1 includes means to affix said nap cushion to a chair back. The back cushion 1 is provided at each lateral side of the rear portion with two elastic string members 12 which each has a hook member 13 connected to a free end thereof, and at each lateral side of the front portion with two retaining rings 21 corresponding to and for receiving the two elastic string members 12 and hook members 13 on the rear portion. The retaining strap 3 is fixed at two lower ends to points adequately above the two pairs of elastic string members 12 and is provided with an adjusting buckle 32 to adjust the length of the strap 3 itself.

The side cushions 2 each has a properly curved inner side surface and are so designed that a smooth curve is formed at a lower joint between the back cushion 1 and the two side cushions 2.

Figure 2:
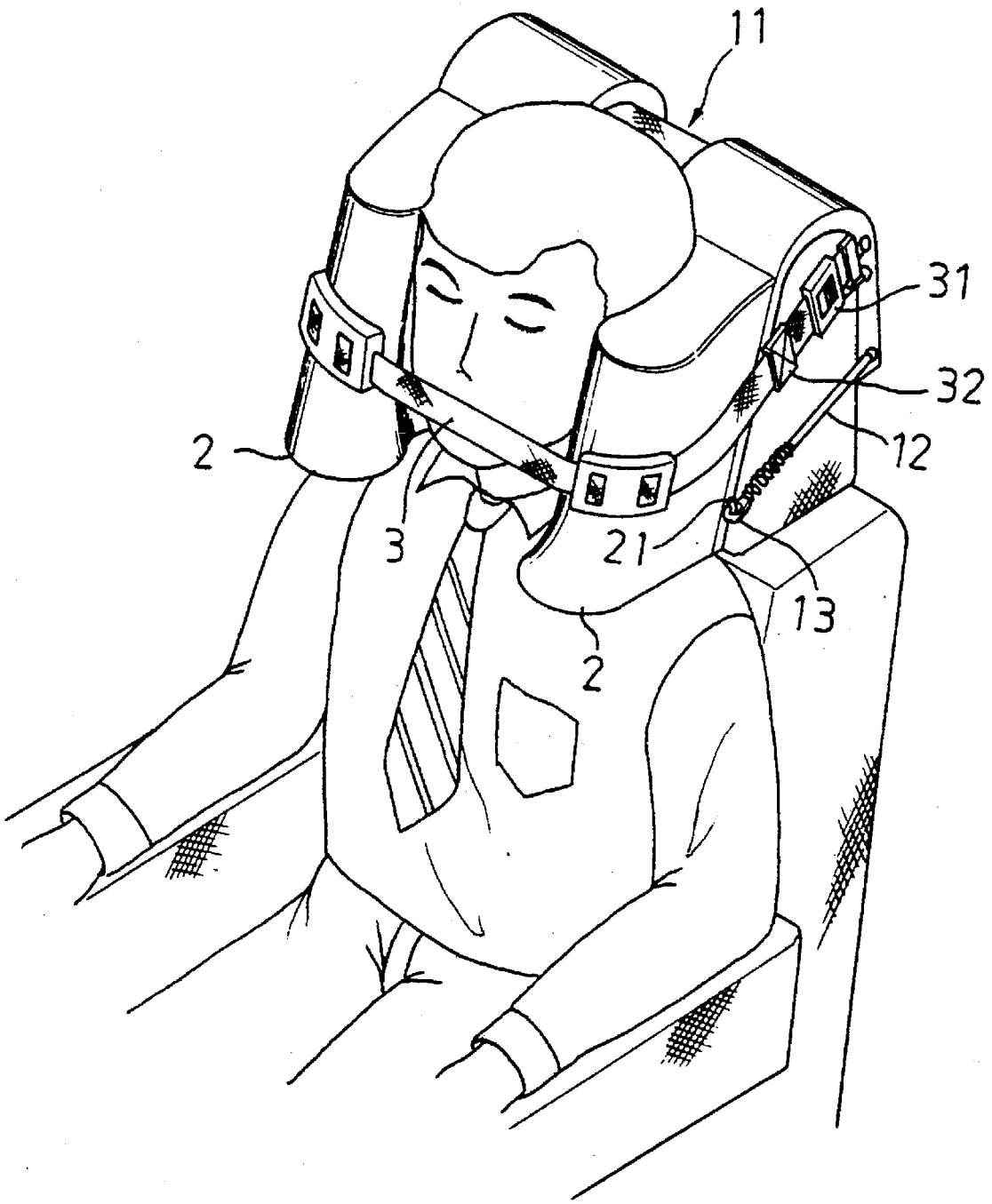
FIG. 2 illustrates an embodiment of the manner in which the present invention is used.
Figure 3:
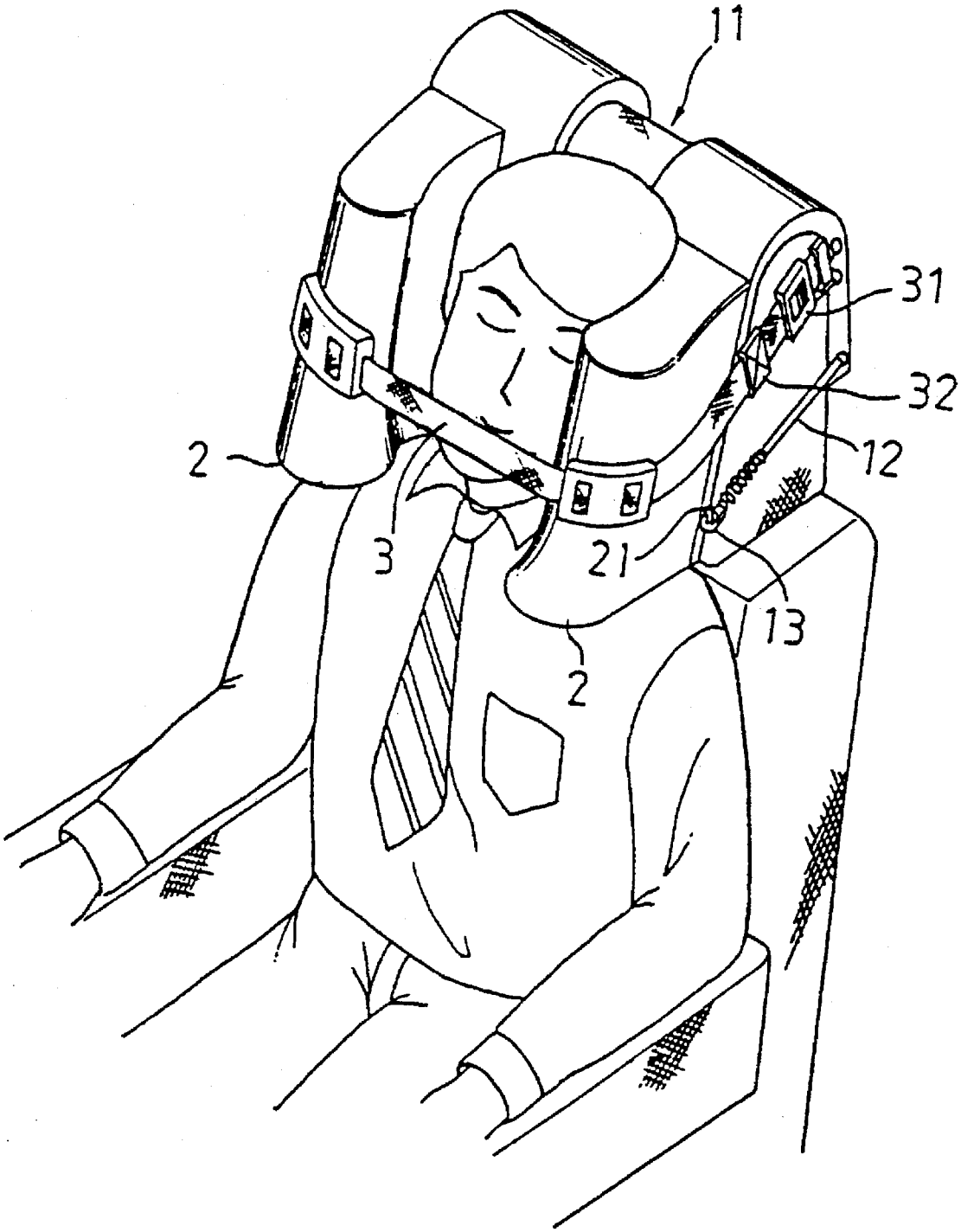
FIG. 3 illustrates another embodiment of the manner in which the present invention is used.

To use the safety nap cushion of the present invention, first inflate the back cushion 1 and the side cushions 2 to a desired softness, put the back cushion 1 over a chair back with the side cushions 2 facing forward and the through opening 11 facing upward, as shown in FIG. 2. Then, engage the hook members 13 on the elastic string members 12 with the corresponding retaining rings 21 so that the safety nap cushion is properly attached to the top of the chair back. To prevent the two inflated but flexible side cushions 2 from swaying sidewardly when they are under pressure, move the retaining strap 3 so that it is pivotally turned from a back position to a position in front of the two side cushions 2 and thereby encloses and confine the latter within the strap 3. Use the adjusting buckle 32 to adjust the retaining strap 3 to a desired length, causing the two side cushions 2 to fitly attach to the user's two cheeks.

The advantages of the safety nap cushion of the present invention are as follows:

1. The side cushions 2 have a curved inner surface which is designed to follow the general configuration of a man's head so that they can fitly contact with the user's cheeks. The retaining strap 3 is length-adjustable and thereby can also help the side cushions 2 to fitly contact the user's cheeks and prevent the same from falling aslant to one side.

2. The retaining strap 3 is detachably attached to the back cushion 1 by means of the two safety buckles 31, and the back cushion 1 is suitable for putting over the user's head through the opening 11 and can therefore be used as an inflatable life jacket.

3. The back cushion 1 and side cushions 2 are provided with air inlets from which the cushions can be inflated manually.

The above embodiment is only used for illustration and is not intended to limit the scope of the present invention. Many modifications of the embodiment can be made without departing from the spirit of the present invention.

What is claimed is:

1. A safety nap cushion for a chair back comprising:

a generally U-shaped inflatable back cushion including front and rear portions, said back cushion having an opening between said front and said rear portions, said back cushion further including means for affixing said nap cushion to said chair back, two curved inflatable side cushions affixed to said front portion of said back cushion, and a retaining strap having two ends pivotally attached by means of safety buckles to two outer sides of said rear portion of said back cushion, said retaining strap including an adjusting buckle to adjust the length of said retaining strap, said retaining strap being positioned such that it can be pivoted forward to surround said side cushions, such that a user's head is retained by said retaining strap between said side cushions.

* * * * *